US011268794B2

(12) United States Patent
Thottethodi

(10) Patent No.: US 11,268,794 B2
(45) Date of Patent: Mar. 8, 2022

(54) REMOTE FIRING MODULE AND METHOD THEREOF

(71) Applicants: Mithuna Thottethodi, West Lafayette, IN (US); TRIGNETRA LLC, West Lafayette, IN (US)

(72) Inventor: Mithuna Thottethodi, West Lafayette, IN (US)

( * ) Notice: Subject to any disclaimer, the term of this patent is extended or adjusted under 35 U.S.C. 154(b) by 0 days.

(21) Appl. No.: 16/628,180

(22) PCT Filed: Jul. 3, 2018

(86) PCT No.: PCT/US2018/040784
§ 371 (c)(1),
(2) Date: Jan. 2, 2020

(87) PCT Pub. No.: WO2019/010223
PCT Pub. Date: Jan. 10, 2019

(65) Prior Publication Data

US 2020/0225015 A1 Jul. 16, 2020

Related U.S. Application Data

(60) Provisional application No. 62/528,197, filed on Jul. 3, 2017.

(51) Int. Cl.

| | |
|---|---|
| ***F42D 1/05*** | (2006.01) |
| ***F42B 3/12*** | (2006.01) |
| ***F42B 4/24*** | (2006.01) |

(52) U.S. Cl.
CPC ..... *F42D 1/05* (2013.01); *F42B 3/12* (2013.01); *F42B 4/24* (2013.01)

(58) Field of Classification Search
CPC ..... F42D 1/05; F42B 3/12; F42B 4/24
USPC ..... 102/202.5, 202.9, 217, 218
See application file for complete search history.

(56) References Cited

U.S. PATENT DOCUMENTS

| | | | | |
|---|---|---|---|---|
| 2006/0277324 | A1* | 12/2006 | Aldereguia | G06F 13/4072 710/1 |
| 2008/0000377 | A1* | 1/2008 | Doyle | F42B 4/18 102/335 |
| 2015/0260489 | A1* | 9/2015 | Bossarte | F41A 19/68 102/360 |
| 2016/0164203 | A1* | 6/2016 | Barker | F42B 4/24 439/78 |

* cited by examiner

*Primary Examiner* — John Cooper
(74) *Attorney, Agent, or Firm* — Gutwein Law; Tyler B. Droste

(57) ABSTRACT

A pyrotechnic firing system for igniting an explosive charge comprising one or more firing modules, a firing control system, and an igniter cable system. The firing module can comprise a transceiver, a memory, an antenna, a processing means, and one or more cues. The firing control system can comprise a processing means, memory, transceiver, antenna, and display. The firing control system can identifying and obtaining information from one or more firing modules. The control system can then assign visual indicators to each of the one or more firing modules and display the visual indicators to a user on the display.

7 Claims, 13 Drawing Sheets

| Voltage range | Igniter Class |
|---|---|
| $V_{sense} > V_{3/4}$ | Class 1 |
| $V_{3/4} > V_{sense} > V_{1/2}$ | Class 2 |
| $V_{1/2} > V_{sense} > V_{1/4}$ | Class 3 |
| $V_{sense} < V_{1/4}$ | Class 4 (no igniter) |

REMOTE FIRING MODULE AND METHOD THEREOF

CROSS REFERENCE TO RELATED APPLICATIONS

This application claims priority to U.S. Provisional Patent Application No. 62/528,197 filed 3 Jul. 2017 to one of the above named inventors, and is herein incorporated by reference in its entirety.

FIELD OF THE INVENTION

This invention relates generally to wireless, electronic firing systems and apparatus used to remotely ignite pyrotechnic devices. More specifically, the invention relates to a wireless ignition apparatus and single-use multi-igniter cable apparatus.

BACKGROUND

Ignition systems for pyrotechnic devices, such as fireworks, can fall into three categories consisting of manual firing, electrical firing and digital firing. Manual firing consists of lighting a fuse where a flame provides the catalyst for igniting the pyrotechnic device. Electrical firing system are a more modern method and widely used consisting of inserting an electrical igniter which includes a bridgewire into the pyrotechnic device, wherein an electrical current provided through the bridgewire ignites the pyrotechnic device. Some embodiments of these systems can be seen in U.S. Pat. Nos. 3,082,690 and 3,811,359. Alternately, the igniter's bridgewire can be clipped to the fuse of the pyrotechnic device. Digital firing uses the same electrical firing principles, but the current sources for the igniter cables are connected to a computer system in order to ignite a pyrotechnic device using software control, such as the embodiment shown in U.S. Pat. No. 5,460,093.

In the pyrotechnic industry, many times it is necessary to have precision timed ignition systems. Traditionally, these ignition systems consist of standalone units that required physical attachment of igniter cables to the explosives of pyrotechnic device for ignition. Recently, wireless ignition systems have been used to achieve safe and precisely-timed ignition from a distance. Professional pyro technicians use them to remotely launch fireworks and can also be used by film crews to trigger explosions, fireworks and other such ignition-based special effects. Similar, pyrotechnic systems can be used in training of fire safety personnel to start test fires for the crew to practice firefighting. These digital systems are expensive and are only typically used by commercial pyrotechnic companies for large pyrotechnic productions.

The systems currently used have many drawbacks that limit their accessibility and use to a larger customer base. One primary barrier is the cost for current stand-alone systems that require all proprietary equipment and controllers to use the system. There exists a need for a more affordable system with greater functionality for a broader consumer base.

Moreover, the current method of securing igniter cables to the firing system consists of individual terminals, with them often times being spring loaded. The terminals require pressure to be applied to be held open. In the absence of any external pressure they terminals are "closed" and they maintain electrical contact. The two leads of the igniter cables are inserted in to a pair of spring-loaded terminals which places the igniter cable on the current path of a full circuit. Because of this organization, a pyro technician must manually connect twice the number of leads as the number of cues he/she plans to use. This method of coupling the igniter cables to the firing system is time consuming and terminals can often time come loose resulting in the electrical current not being applied to the igniter cable. Another objective of the present invention is to provide an improved igniter cable apparatus, capable of being quickly, yet securely connected and disconnected from the ignition system.

Additionally, most firing systems use current pulses of fixed duration independent of the igniter type, with some systems using current pulse duration tuned to each igniter type. For example, a longer pulse for the bare-bridgewire igniters and a shorter pulse for the pyrogen-coated igniters. However, the systems require the user to explicitly set the type of igniter on the firing module to achieve the appropriate burn-time. Another objective of the present invention is a system that can automatically detect the igniter type and length and set burn time accordingly.

Furthermore, traditional firing system remote controllers that can control a plurality of firing modules typically use "channel based" addressing in which the remote controller transmits commands on channels which are then executed by all firing modules that are listening/receiving on that channel. Thus, both remote controller and receiver must be configured to communicate over the same channel. Further, if multiple firing modules are configured to listen to the same channel, they will all receive commands broadcast on that channel and fire the appropriate cues. Such channel-based addressing can be error prone as it requires coordinated channel setting on both the remote controller and the firing module. Therefore, there exists a need to have a firing system to eliminate the need for coordinated programming and configuration of multiple modules and remote controllers.

BRIEF SUMMARY OF THE INVENTION

In one aspect, this disclosure is related to a pyrotechnic firing system for igniting an explosive charge comprising one or more firing modules, a firing control system, and an igniter cable system. The firing module can comprise a transceiver, a memory, an antenna, a processing means, and one or more cues. The firing control system can comprise a processing means, memory, transceiver, antenna, and display.

In another aspect, this disclosure is related to an igniter cable system, comprising a one or more igniter cables coupled to a cable base, wherein the cable base is configured to be removeably coupled to a firing module.

In another aspect, this disclosure is related to a method wherein the microcontroller is configured to identifying and obtaining information from one or more firing modules using the firing control system; assigning visual indicators to each of the one or more firing modules; and is displaying the visual indicators to a user on the display.

BRIEF DESCRIPTION OF THE DRAWINGS

The features and advantages of this disclosure, and the manner of attaining them, will be more apparent and better understood by reference to the following descriptions of the disclosed system and process, taken in conjunction with the accompanying drawings, wherein.

DETAILED DESCRIPTION OF THE INVENTION

While fireworks are widely used for special occasions and celebrations, there is an inherent risk consumers incur when igniting traditional fireworks. Similarly, these consumers are also limited to hand lighting methods that can lead to various injuries from a misfire by a pyrotechnic device. Often consumers are also limited to igniting a single firework at a time by themselves without risking further injury.

Figure 1:
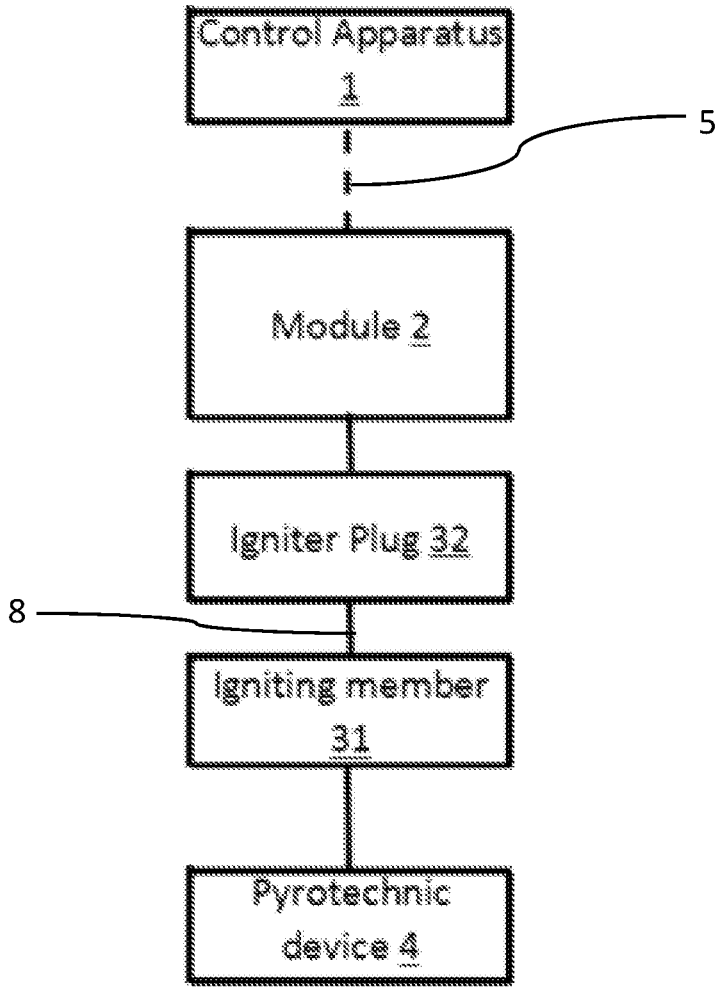
FIG. 1 is an illustration of an exemplary embodiment of a wireless electronic firing system of the present invention.

FIG. 1 illustrates an exemplary embodiment of an ignition system of the present invention. The present invention can be comprised of one or more firing modules 2 that can be communicatively coupled to a system controller apparatus 1. In one exemplary embodiment, a plurality of firing modules 2 can be controlled by a single system controller 1. The firing module can be communicatively coupled to a pyrotechnic device 4, such as an explosive or firework. In one exemplary embodiment, the coupling device between the firing module and the pyrotechnic device can be an igniter cable 8. The controller apparatus 1 and one or more modules 2 can be communicatively connected, such as through a wireless network or hardwired in electrical communication. The module 2 can be coupled to an igniter cable system having a plug 32. On the opposite end of the bridgewire 8 an igniting member 31 can be coupled to the pyrotechnic device 4 to initiate the pyrotechnic device.

The igniting member 31 can further comprise a clip that can be coupled to the ignition source of the pyrotechnic device 4, such as a fuse. In one exemplary embodiment, the clip can be located on a first end of the cable and the second end of the cable can be coupled to a firing module. The bridgewire or igniter cable 8 can be single or multiple use in nature. In one exemplary embodiment, the igniter cables 8 can be have a transceiver coupled to allow the cable to operate wirelessly from the module. Alternatively, the igniter cables 8 can be coupled to a firing module 2, wherein the module 2 emits the current directly through the cable 8 for igniting the pyrotechnic device. In another embodiment, the igniter cables 8 can be e-matches that may be coupled to the pyrotechnic device using similar or alternate means.

The firing module can comprise one or more cues for transmitting the electric current through an igniter cable system or single igniter cable 8. In one exemplary embodiment, the cues can be spring loaded to couple to the second end of an igniter cable 8. In an alternative embodiment, a cue can be configured to act as a plug receptacle for easy removeable attachment to an igniter cable 8. A plurality of cues 22 can for a plug receptacle 21 allowing a user to removeably couple an igniter cable 8 pack have a correlating plug to the plug 32 receptacle 21. As shown in FIG. 1, in one exemplary embodiment, the cue receptacle 21 can be female in configuration and the cable pack plug 32 can be male in configuration. It is understood that the opposite configuration can exists where the receptacle is male in nature and the plug is female in nature.

Figure 2A:
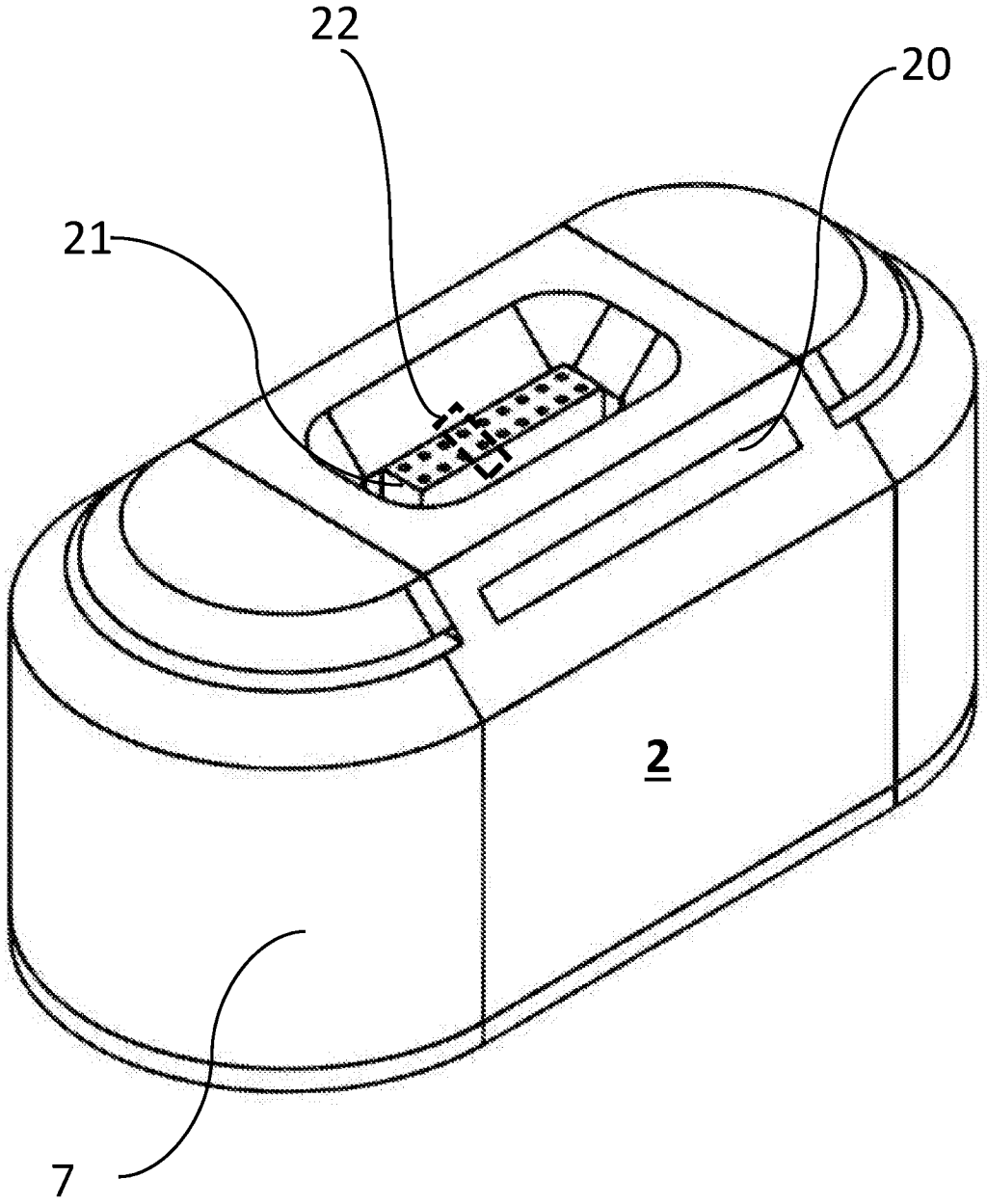
FIG. 2A is an illustration of an exemplary embodiment of a module having a quick disconnect and capable of firing a plurality of pyrotechnic devices.
Figure 2B:
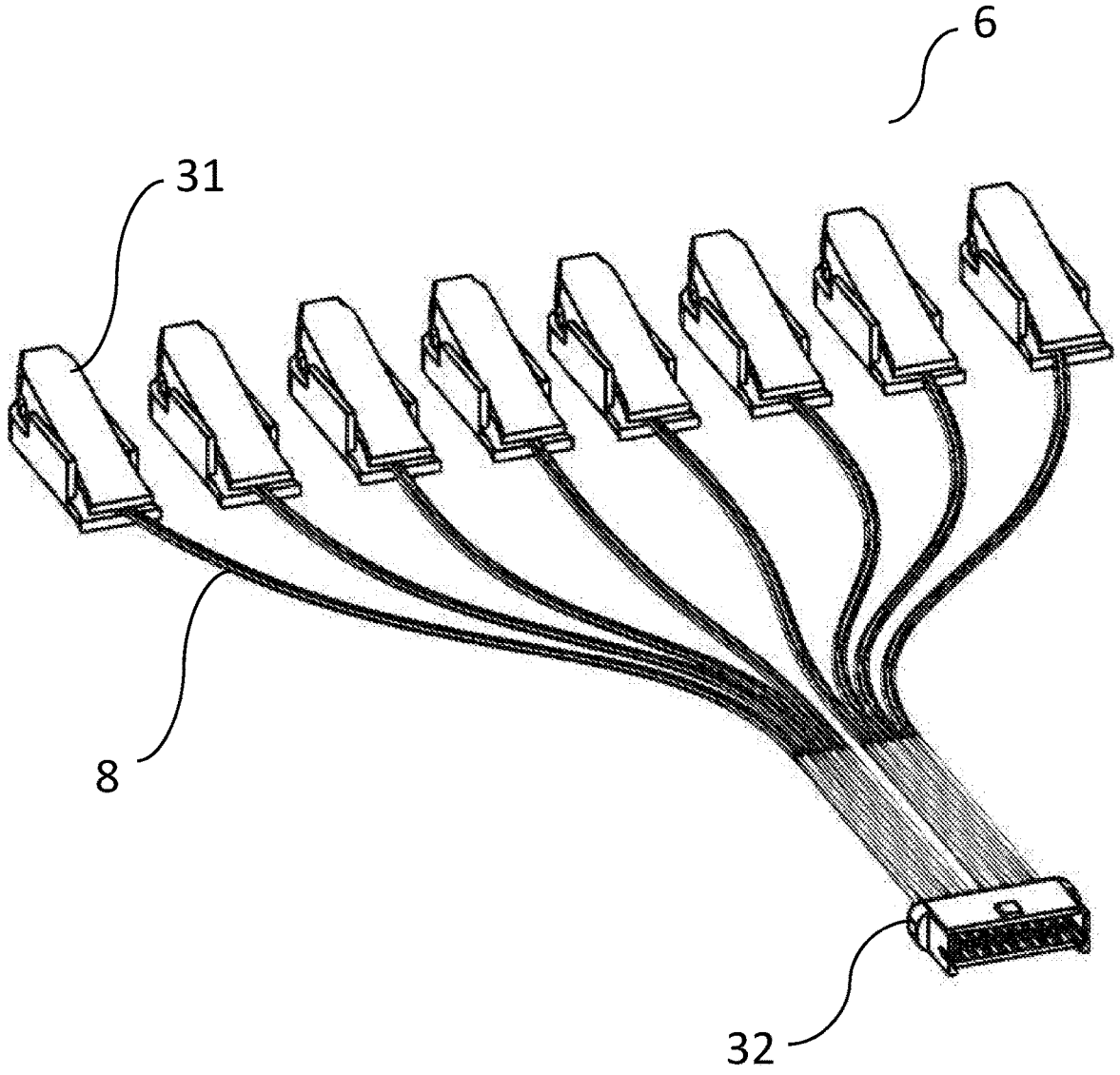
FIG. 2B is an illustration of an exemplary embodiment of an igniter cable system having a plurality of igniter cables and igniting members couple to a single plug interface for quickly disconnecting and connecting to the module shown in FIG. 2A.
Figure 2C:
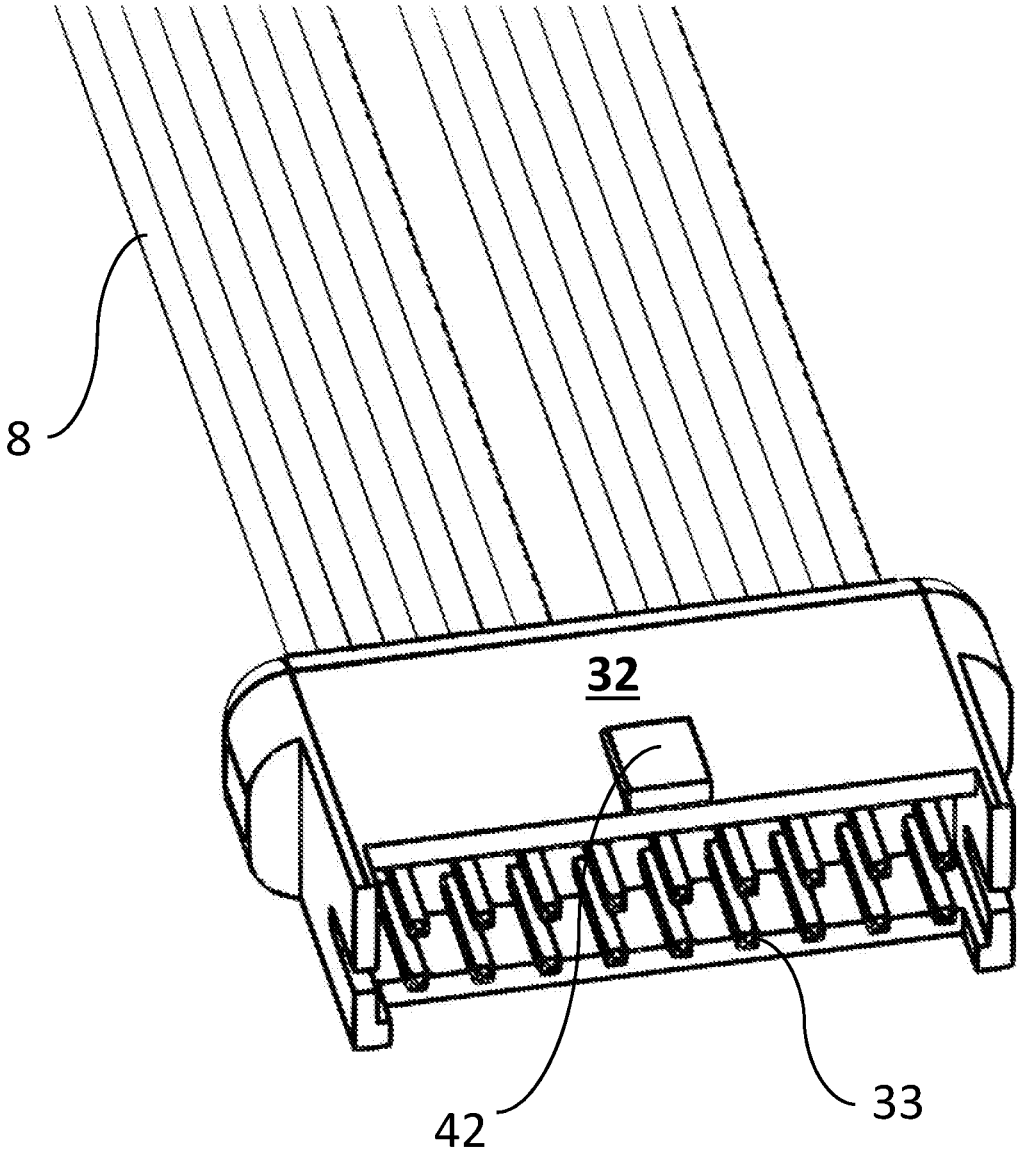
FIG. 2C is an enlarged view of the plug end of the igniter cable system of FIG. 2B.

The igniter cable system 6 can be comprised of one or more igniter cables 8 or e-matches and a cable base 32. As shown in FIG. 2B, one or more igniter cables 8 can be pre-coupled to the cable base. In one exemplary embodiment, the cable plug 32 can accommodate about eight igniter cables 8. However, it should be understood that the plug can be adapted to and configurable to a wide number of cable designs. The cable plug 32 can be configured to be removeably coupled to a firing module 2 at the receptacle 31. The cable plug 32 can further comprise insertion pins 33 that correlate to each of the igniter cables 8 coupled to the base receptacle 21. The base can then be inserted to a corresponding receptacle on a firing module allowing a user to easily attach and detach a one or more igniter cables 8 to a firing module.

The firing module 2 can be dispatched firing commands by the system controller/microcontroller apparatus 1 to one or more firing modules 2 and additionally can control individual cues 22 on a firing module 2. When a firing command is transmitted, the module 2 responds to the command by sending a surge of current through the igniter cable 8. The igniter cable 8 can have a heating element that burns white hot, such as a nichrome bridgewire, which can ignite a pyrotechnic device 4 when the surge of electric current passes through it. Alternatively, the igniter cable 8 can use a chemical accelerant, such as pyrogen, that is coated on the heating element to achieve faster ignition. Such igniters need shorter duration pulse of current to achieve ignition.

The igniter cable system 6 can be manufactured by bundling together a plurality of individual igniter cables 8 by crimping the leads into a base/plug 32 with corresponding conductor elements for each individual igniter cable 8. In one exemplary embodiment, more than one igniter cable 8 can be coupled to a conductor element. The base/plug 32 is configured to couple to a receptacle 21 on the firing module 2 (e.g. female conductor elements on the firing module with male pin conductor elements on the base of the igniter cables 8 system and vice versa). This allows for a user a single action to capable of removeably coupling a plurality of igniter cables 8 at once. The plug/base 32 and receptacle 21 can further use a securing mechanism to further ensure that the base and receptacle are sufficiently interlocked, such as a pressure release clasp. The individual igniter cables 8 can be further identified through markings on the wires themselves or identification markings on the plug 32 and or firing module receptacle 21.

Additionally, the igniter cable system can convey additional type-identifying information that can be detected by the firing module 2 of the present disclosure. The type-identifying information may be conveyed via identification mechanisms that include, additional circuits in the bundle that vary in resistance, which can be sensed by analog-to-digital converters measuring voltage across a voltage divider. This can include a length/type detection system and/or a continuity detection system, wherein the module can include the addition circuits to determine the additional information. Similarly, mechanical notches in the plug housing 32 that encode an igniter type or barcodes or similar reflective marks on the plug 32 can be sensed via an optical/IR sensor. In another embodiment, RFID tags on the plugs can be sensed via an RFID reader to correlate the igniter type to the firing module and control system. In one exemplary embodiment, each igniter cable 8 can have an individual igniting member 31, such as a clip that can then be coupled to a pyrotechnic device 4. The igniter cable system can be commercially produced in a wide variety of bundles to correspond to a variety of receptacle types. The pre-fabricated igniter cable 8 bundles can provide greater efficiency and ease of use for setting up a pyrotechnic display that would traditionally take a large amount of time. Additionally, the connectable base/plug system 32 ensures greater electrical connection with the firing module 2. The igniter cable system 6 can use one or more igniter cables 8 that can be communicatively coupled, including but not limited to an electric connection, to a respective pyrotechnic device and selective communication with a cue on the firing module. The cable plug 32 can have one or more conductor elements that are communicatively coupled to an individual igniter cable 8. The cable plug 32 can act as a plug to a receptacle on the firing module 2, wherein each conductor element correspond with an individual cue of the firing module.

A firing module 2 can further comprise a power source 102, antenna 104, and transceiver 106. The power source 102, antenna 104, transceiver 106, and one or more cues that can be communicatively coupled. In one exemplary embodiment, the power source 102 can be a battery, such as a standard 9V batter that is commercially available. The transceiver 106 can allow a module 2 to be communicatively coupled to a control system apparatus 1. The firing module 2 can further comprise a memory 114. Similarly, each firing module 2 can also include a microcontroller 100, which can have and analog-to-digital converter 126. Additionally, the firing module 2 can have a visual indicator configured to provide information to a user. The firing module 2 can include other elements, such as a power converter, optical/IR sensors, and RFID readers. These additional elements can provide analysis of igniter cable 8 type to better determine the type of electric pulse necessary for firing individual igniter cables 8. The firing module 2 can include a length/type detection system 110 communicatively coupled to the microcontroller 100 for determining the length of the cable which can be used to modulate the duration and/or the amperage of the current pulses. The length/type detection system 110 can also be used to determining the type of detonator being used with the system. Additionally, the module 2 can include a continuity detection system 112 communicatively coupled to the microcontroller 100 to determine if one of the bridgewire/cables 8 has been broken and the continuity of the electrical signal from the module base 21 to the igniter clip/end 31. The system can determine which cue 22 or bridgewire 8 is affected and notify the user through the display 3.

Figure 6:
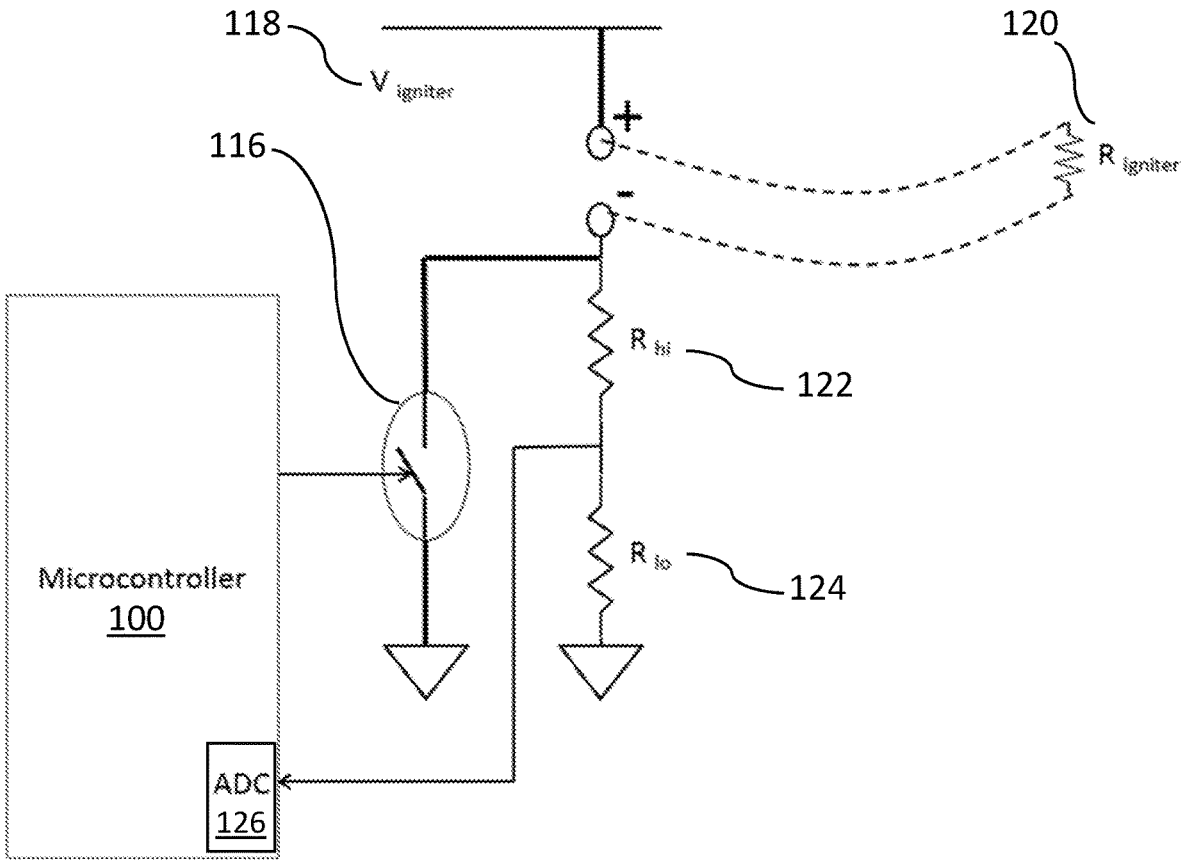
FIG. 6 is an illustration of a continuity detection circuit of the present disclosure.

FIG. 6 shows an exemplary circuit diagram that can be used with the continuity detection system 112. For normal ignition, the microcontroller 100 can control a switch 116 that closes a high-current path from a $V_{igniter}$ 118 to ground. The high current flowing through the cable, such as an igniter bridgewire ($R_{igniter}$) can cause ignition.

For conducting continuity testing by the continuity detection system 112, the switch 116 stays open. When an igniter cable connected to the cue 22 terminal, there is a low-current path from $V_{igniter}$ 118 to ground via $R_{igniter}$ 120, $R_{hi}$ 122 and $R_{lo}$ 124. $R_{hi}$ 122 and $R_{lo}$ 124 are chosen so that the current is below the testing current of the igniter. Testing currents can be maintained low enough that there is no meaningful heating of the bridgewire/igniter cable 8. Further, $R_{hi}$ 122 and $R_{lo}$ 124 can be tuned to make sure that (1) the voltage between $R_{hi}$ 122 and $R_{lo}$ 124 which is the input to the analog-to-digital converter (ADC) 126 of the microcontroller 100, is within the sensing range of the microcontroller 100, and (2) the voltage $R_{hi}$ 122 and $R_{lo}$ 124 is high enough to be clearly distinguishable from near-ground voltage. The symbol 'ε' or 'epsilon' is used to mean the low voltages that are close to ground voltage. The first condition above may be necessary because the voltage used for ignition is typically higher than the analog sensing range of common microcontrollers. The second condition is necessary to distinguish from the case where there is no continuity as described below.

Figure 7:
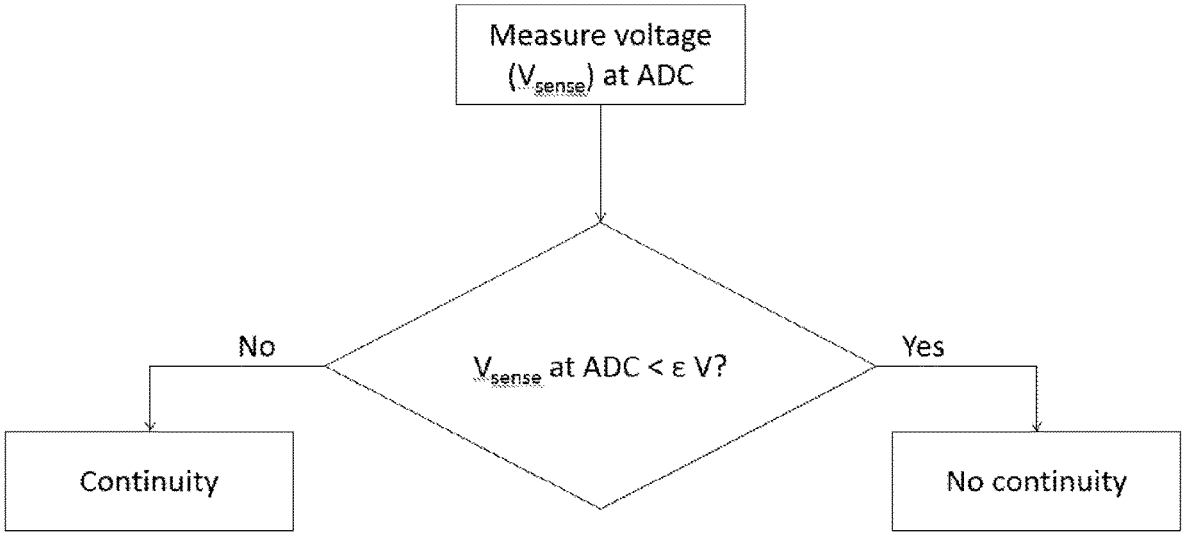
FIG. 7 shows a flow chart for the system logic of the continuity detection system of an exemplary embodiment of a module of the present disclosure.

When no igniter cable is connected, or alternatively, if the igniter cable has been cut/damaged, there is no current path from $V_{igniter}$ to ground. $R_{hi}$ 122 and $R_{lo}$ 124 act as pull-down resistors bringing the sensed voltage input to near-zero (i.e., ground voltage). As shown in FIG. 7, based on the above operation, continuity detection is a simple process wherein the voltage between $R_{hi}$ 122 and $R_{lo}$, 124 is sensed ($V_{sense}$) and based on whether the sensed voltage is near-ground-voltage or distinctly higher than ground voltage. From this voltage sensing it can be determined if there is no continuity, or that there is continuity, respectively.

Figure 8:
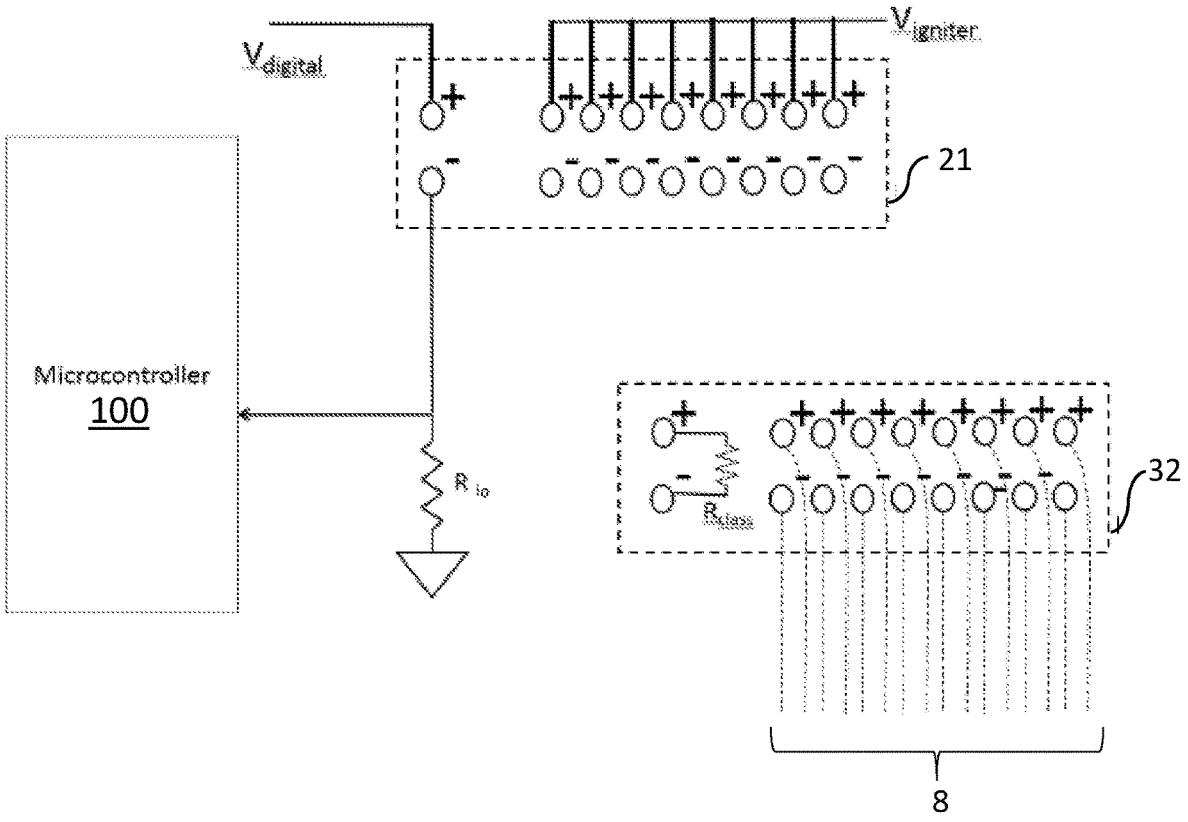
FIG. 8 is an illustration of a type and/or length detection circuit of the present disclosure.

Similarly, the module can include an igniter class type and/or length detection system 110. FIG. 8 illustrates a circuit diagram that can be used with the length/type detection system 110. Igniter cables may be thought of as being in distinct classes based on length and type of cable. For example, two distinct types of igniters (i.e., e-match and bare-bridgewire) and three distinct cable lengths (i.e. 1 meter, 3 meter, and 5 meter), that leads to a total of 6 possible igniter cable classes.

One way to store this class information in the cable so that the cable type is detectable is to use an additional pair of terminals in the igniter connector. As shown in FIG. 8, one exemplary embodiment of the system of the present disclosure may use about 8 individual igniter cables in one multi-igniter cable pack/plug 32, the receptacle 21 and the plug 32 actually can support 9 pairs of terminals. The additional pair of terminals may be connected with a carefully-selected resistor ($R_{class}$) that helps detect the class of the cable.

Figure 9:
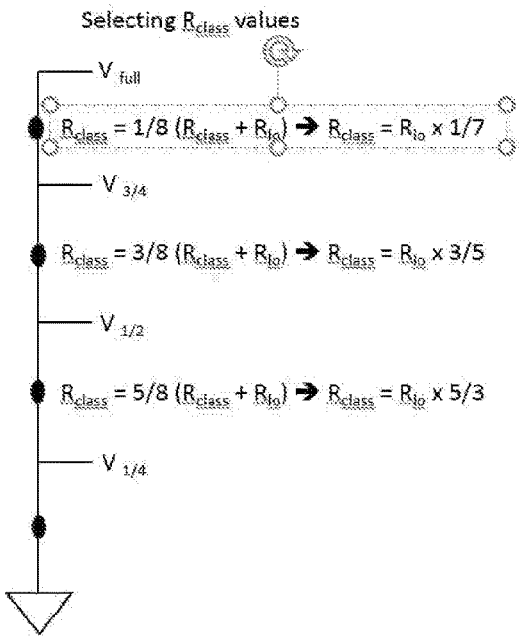
FIG. 9 is chart for the type and/or length detection system of an exemplary embodiment of a module of the present disclosure to classify igniter classes.
Figure 9:
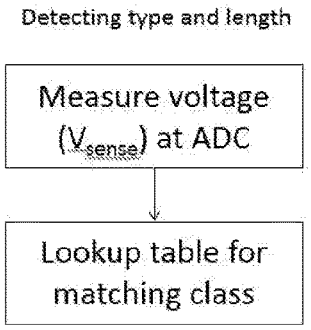

FIG. 9 illustrates a detection system that helps detect 3 classes (plus the fourth 'null' class to indicate that no cable is connected). The design may be generalized to detect more classes as necessary. The $R_{class}$ resistor embedded in the cable can be used in series with another $R_{lo}$ resistor on the firing module 2 to act as a voltage divider. When the positive terminal is driven with a supply voltage of $V_{digital}$, the voltage divider can effectively divide the voltage in such a way that the voltage at the negative terminal is $(R_{lo}/(R_{class}+R_{lo}))\times V_{digital}$.

As shown in the FIG. 9, the full voltage range can be divided into sub-ranges corresponding to the number of classes. The voltage range can be divide into 4 equal ranges. In one exemplary embodiment, the $R_{class}$ values can be chosen such that the voltage at the negative terminal, which can be sensed at the analog-to-digital converter, is within the ranges. For the three cable classes, the $R_{lo}$ value can be selected independently and may be selected in a manner so as to not be too low in order to avoid wasted current leakage. Once $R_{lo}$ is chosen, $R_{class}$ can be derived based on the target voltage needed at each class. As shown in the FIG. 9, the three values of $(R_{lo}/7)$, $(3\times R_{lo}/5)$, and $(5\times R_{lo}/3)$ result in the required voltage division for the three cable classes. When no cable is connected, $R_{lo}$ acts as a pull-down resistor and the sensed voltage is near-ground-voltage, resulting in the fourth class being identified.

Once $R_{class}$ values are selected, the cables can be manufactured with the appropriate $R_{class}$ values depending on the type and length. During operation, the class can be detected by sensing the voltage at the negative terminal and comparing the detected voltage the range boundaries of each class. To avoid misclassifying cables (e.g., because of electrical noise which may perturb the voltages) it beneficial to select ranges that offer adequate noise protection. In the exemplary embodiment provided, even if minor variations in voltage are observed from the design values that lie at the middle of their respective ranges, the wide ranges of the voltage boundaries ensure that cable classes are correctly detected.

Figure 4:
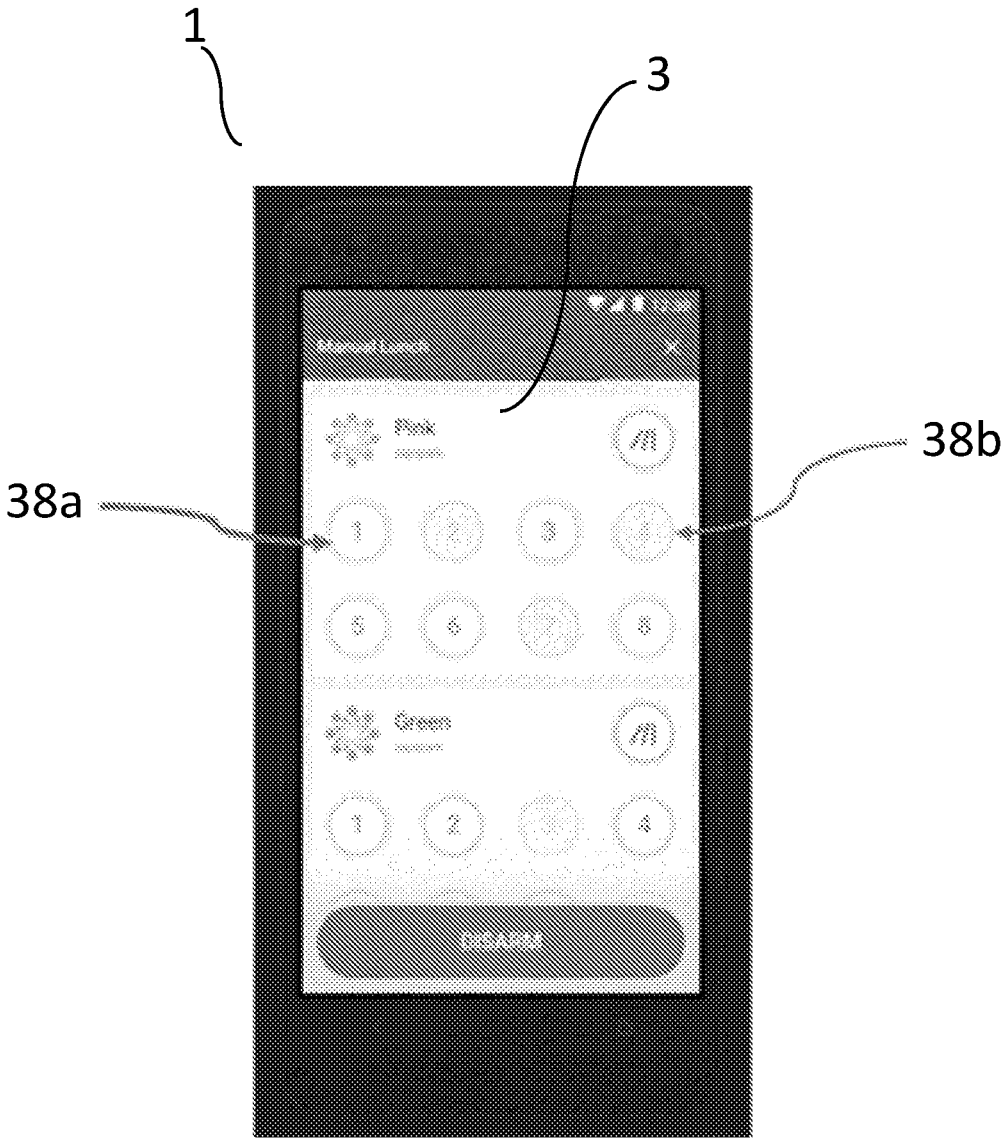
FIG. 4 is an exemplary embodiment of the visual indication provided by the display of the control system having virtual buttons and module identification references.

The control system apparatus 1, such as a computer, tablet, or smartphone, can be used to control the firing of pyrotechnic devices through the firing module cues 22. The control system can comprise a processing means, an antenna, a transceiver, and a memory. The control system apparatus 1 can further comprise a display 3 that provides a physical display of the various modules in communication with the control system and as well as depicting each cue within the module on the display, as shown in FIG. 4. In one exemplary embodiment, the control system 1 and firing module(s) 2 is communicatively coupled to send inputs and outputs from the control system to the firing module 2 via a network 5. In the present embodiment, wireless communications may be at any allowed frequency or utilizing any standard or non-standard communications protocol. Communications between the control system and firing module(s) may be via any transmission protocol including, but not limited to, RS232, RS485, HDLC, SDLC, HTTP, TCP/IP, Zigbee, 802 standards, USB, Ethernet, LAN, WAN, FSK, closed caption, Bluetooth, cellular network protocol, and be serial or parallel in nature. Similarly, a transmission cable can be communicatively connecting the firing module 2 to the control system 1.

Figure 2D:
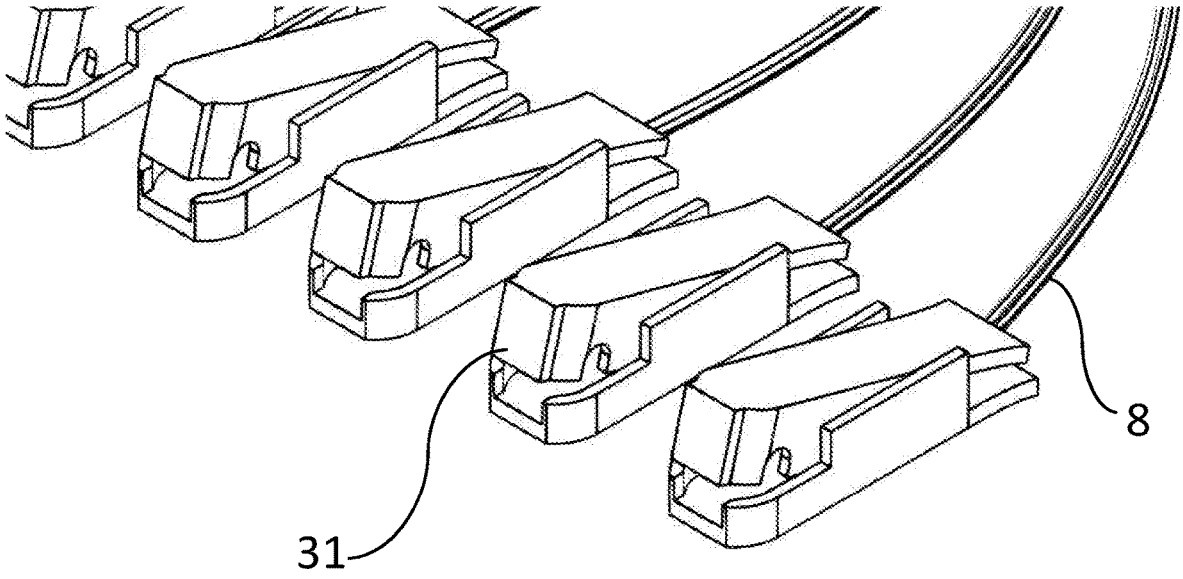
FIG. 2D is an enlarged view of an exemplary embodiments of igniting members of the igniter cable system of FIG. 2A.
Figure 3:
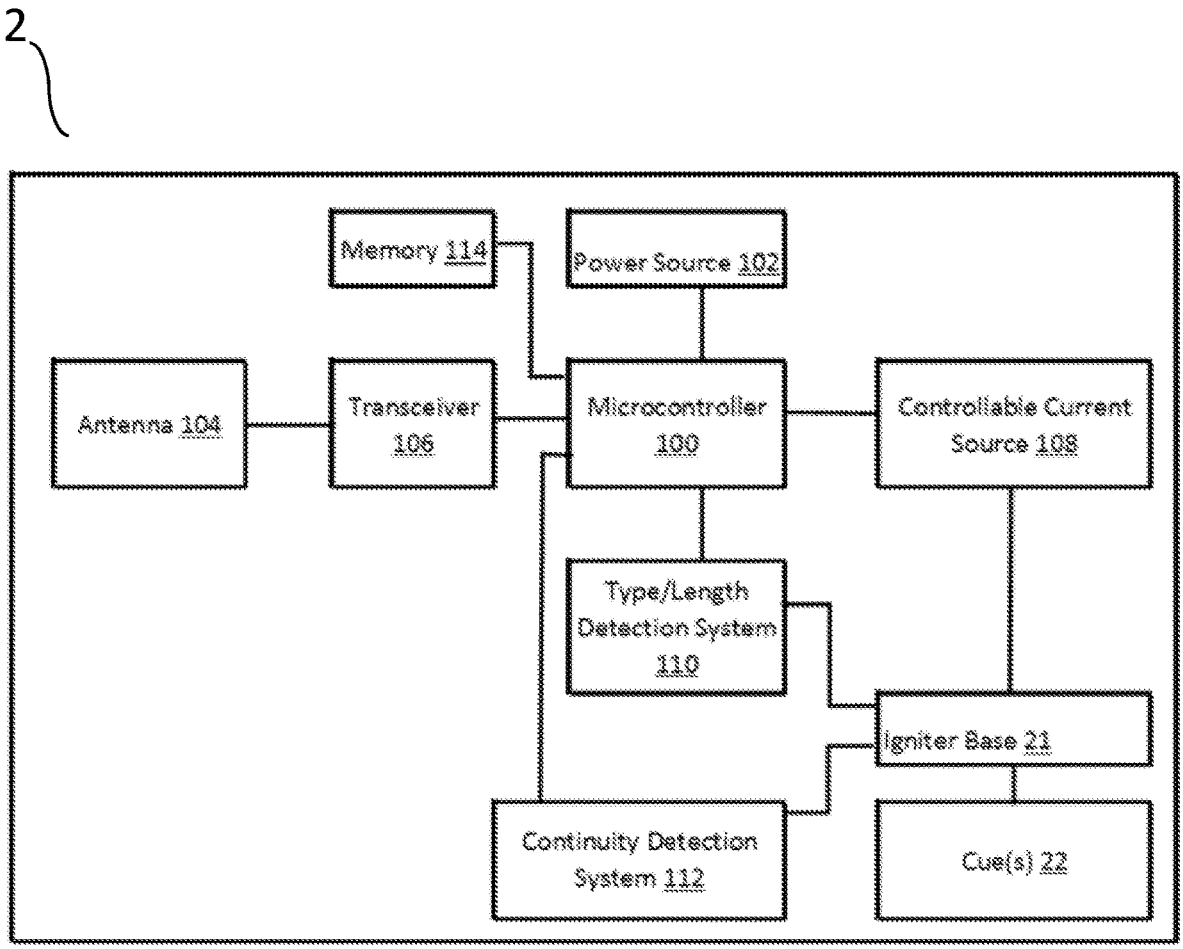
FIG. 3 is a block diagram of the module of the present disclosure.

In one exemplary embodiment of the pyrotechnic firing device, a smartphone or tablet (or an app on the smartphone/tablet, to be precise) can be used as the firing control system/controller 1. Given that many consumers already have a smartphone or tablet, the cost associated with the firing system of the present disclosure is greatly diminished. Additionally, the firing module 2 of the system can use a bundle of igniter cables 8 that have been bundled to have a single plug 32. At the other end of the bundle, there may be a plurality of individual igniting members 31, such as igniter clips as shown in FIGS. 2B and 2D. In one exemplary embodiment, the bundle can include about eight igniter clips 31 that be used to detonate eight separate pyrotechnic devices 4. Similarly, each igniter cable 8 may be coupled to multiple fuses of the pyrotechnic device 4 allowing for detonation of a plurality of pyrotechnic devices 4 per cue 22.

A complementary receptacle base 21 can be present on a firing module 2 which allows for the pre-bundled igniter cable 8 package to be coupled to the firing module 2 with a single user action. This dramatically reduces the time and effort needed to couple pyrotechnic devices 4 to the firing module 2, allowing for greater efficiency and control of the pyrotechnic devices 4. This invention eliminates the need to attach the dual lead of each individual igniter cable 8 has to be independently secured in its corresponding spring-loaded terminal, as is the current method. Note that pairs of contact terminals in the plug receptacle 21 can be considered to logically be a cue 22. Third, the igniter cables 8 can include encoding of additional information to identify the type of igniting member 31, such as an igniter clip.

As mentioned before, the additional information could be included as an additional pair of terminals with a unique resistance value. Other possibilities include RFID tags, optical/infrared markers and physical pits/bumps on the plug casing which can be sensed in the firing module. Similarly, in embodiments that use the spring actuated method of coupling the igniter cables 8 to the firing module 2, the system can detect when the cables 8 have been appropriately coupled to the firing module 2. If the connection does not allow for a current path (which will prevent ignition), the display 3 can provide visual feedback as to which cue 22 is not appropriately attached or may be otherwise damaged. Similarly, the display 3 can determine and illustrate the cues 22 which do have a current path so that those cues may be coupled to a pyrotechnic device 4. The cues 22 may include a pair of terminals or a single terminal.

Additionally, each firing module can have a key visual feature or module identification reference, such as an assigned color or other visual indicator. In one exemplary embodiment, the module housing 7 of the firing module can have a pre-determined color. Alternatively, the module housing can include a display 20, such as a multi-color LED or digital read out, to indicate the associated module identification reference. The color of the firing module will then be displayed on the display 3 of the controller 1. Alternatively, or in addition to, a firing module can have a light 20 visible from the exterior of the module. The light 20 can display a unique color prescribed to the particular firing module. The control system can assign a color to each firing module, which the firing module can then display. The light can be any suitable light, such a multi-color light emitting diode (LED). Alternatively, a display can be located on the exterior of the firing module to provide a unique visual reference to each firing module.

Figure 5A:
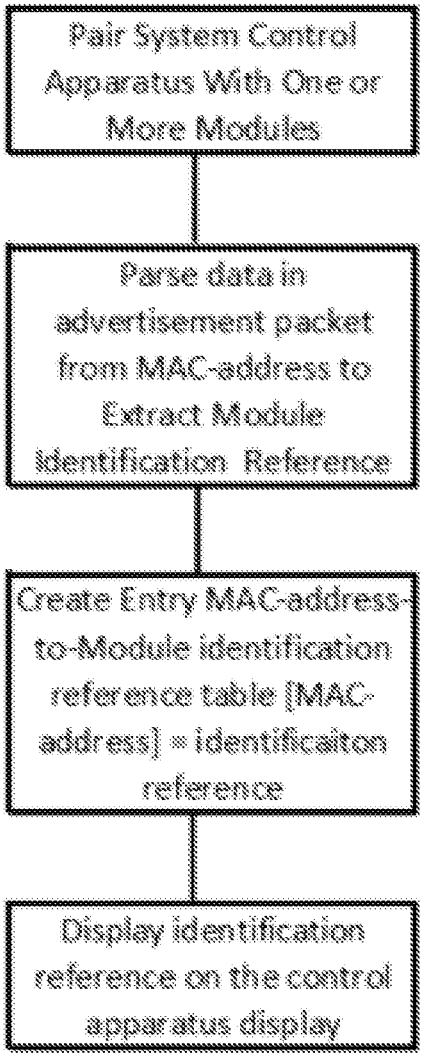
FIG. 5A is a flow diagram of the assignment process of designating a pyrotechnic device with a visual indicator for the one or more pyrotechnic devices using the present invention.
Figure 5B:
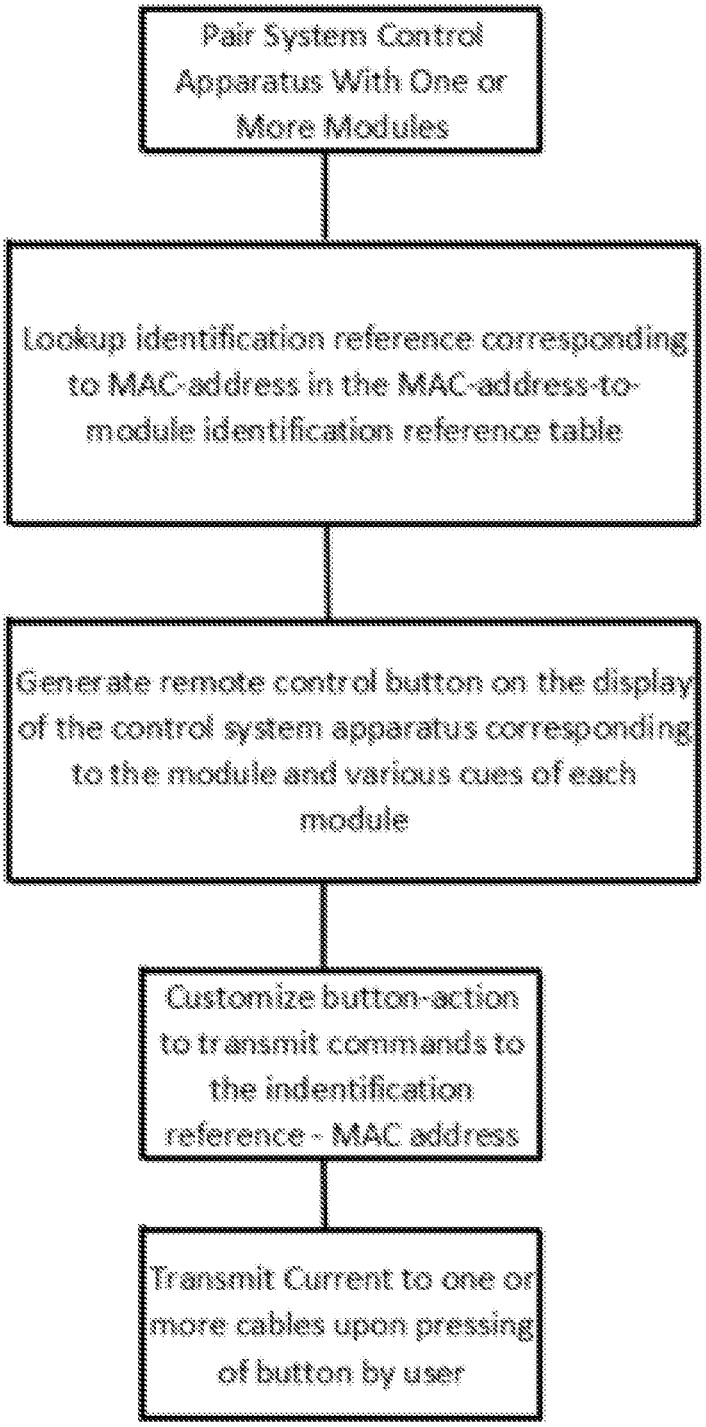
FIG. 5B is a flow diagram of the lookup and correlation function used to identify and customize commands for the one or more pyrotechnic devices using the present invention.

FIGS. 5A-B illustrate the processes of the present invention determining the presence of the igniter cable 8 and/or pyrotechnic device and assigning the individual wire(s) a visual reference. The visual display can use alpha-numerical assignments to identify each module with a unique identifier. A user can then be provided correlating visual data on the control system display 3. The firing modules can then be addressed visually using their visual reference feature. This is critically important for networks that do not use channel-broadcast communication like Wi-Fi and Bluetooth. The program or app ran by the control system can identify and map the visual indicator of each firing module to a MAC addresses (unique network addresses) or similar method. Thus while the user-friendly view in the app allows them to address devices by visual indicator, such as color, the underlying app can translate the colors to MAC addresses to achieve communication. The mapping may be stored locally on the memory of the firing module, which the app can then query. In other embodiments, the color-to-mac address mapping may be stored on a central backend server or external storage/memory that the control system can query to identify each firing module.

The control system 1 can use software-rendered buttons 38*a, b* on the display 3 to allow a user to control the pyrotechnic firing system of the present disclosure. The color of the buttons can be configured to correlate to a specific firing module, allowing for visual addressing of endpoints of the pyrotechnic system. FIG. 4 illustrates a displaying showing multiple modules connected to the controller 1 with each module having a plurality of cues 22. The buttons can change color or become faded depending upon if the pyrotechnic device has been fired or has yet to be fired. Similarly, pre-determined ordering can be set and stored in the memory of the module 2 or the control system 1 to allow a user to have defined pyrotechnic sequences as desired by the user.

The visual addressing system of the present invention eliminates the need for coordinated programming/configuration of both firing modules 2 and control system 1. Instead, the visual addressing can uniquely address each endpoint using the physical color/pattern of the firing module 2 or the stored identifier in the memory of the firing module. The invention bootstraps the visual addresses in a discovery stage and to use such known visual addresses for active communication during normal operation and communication between the firing module(s) and the control system. In one exemplary embodiment, the housing of the firing modules are different colors, which can be used in the visual addressing system. In this embodiment, the visual addressing uses visual characteristics of the firing module as the address of the firing module for the purpose of user-interaction. The underlying communication can still us the MAC addresses, but these addresses can remain hidden from the user and instead the visual addressing is provided on the display of the control system.

The control system can store a program that is configured to control the firing modules and can initiated a two phase program a first for discovery of firing modules and a second phase for operation of the firing modules. In the discovery phase, the firing module can inform the control system of its visual addressing identifier and its MAC address. The control system 1 can then save the color/pattern-to-MAC address translation in an internal software table on the memory, storage or server communicatively coupled to the control system 1. In all subsequent uses, the control system 1 can create firing buttons 38 with the color pattern of the known firing modules 2 that were identified/discovered. When the user actuates the buttons 38, the underlying mapping can be used to send commands to the appropriate end-point, such as the firing module 2, or even more specifically a cue 22 of the firing module. This can allow a user to detonate all pyrotechnic devices 4 coupled to a single module at the same time or alternatively to only detonate a pyrotechnic device to a particular cue 22 of the module 2.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

What is claimed is:

1. A pyrotechnic firing system for igniting an explosive charge comprising:

at least one firing module comprising a housing, power source, an antenna, a transceiver, one or more cues, and a receptacle base having at least one cue, wherein the firing module further comprises a visual indicator display configured to display the assigned visual indicator for the module;

a firing control system communicatively coupled to the firing module, wherein the firing control system comprises a power source, an antenna, a transceiver, a memory wherein the memory includes an indicator database of one or more firing modules, a microcontroller wherein the microcontroller is configured to sense and assign one of more firing modules and one or more individual cues of a firing module a visual indicator, and a display, wherein the firing module visual indicator and cue visual indicator is provided to the user on the display; and an igniter cable system comprising at least one igniter cable having a first end and a second end, wherein an igniting member is communicatively coupled on the first end of the cable and a receptacle plug is coupled on the second end of the cable, wherein the receptacle plug is configured to removably couple from the receptacle base of the firing module, wherein the igniter cable system comprises a plurality of igniter cables, wherein the receptacle plug includes an individual cue and correlating pin for each individual igniter cable and said receptacle plug is configured to be removably coupled to a receptacle base of a firing module, wherein the firing module and the firing control system are wirelessly coupled via a network, wherein the firing module further comprises a length and type detection system configured to detect the type and length of one or more igniter cables; and a continuity detection configured to detect the presence of one or more igniter cables.

2. The firing system of claim 1, wherein the microcontroller is configured to detect the type and length of one or more igniter cables.

3. The firing system of claim 1, wherein the firing module further comprises a microcontroller and memory.

4. The firing system of claim 1, wherein the receptacle plug has a pin corresponding to the igniter cable and the receptacle base has an aperture for accepting said pin.

5. The firing system of claim 1, wherein the microcontroller is configured to identify and obtain information from one or more firing modules using the firing control system; assign visual indicators to each of the one or more firing modules; and display the visual indicators to a user on the display.

6. A pyrotechnic firing system for igniting an explosive charge comprising:

at least one firing module comprising a housing, power source, an antenna, a transceiver, one or more cues, and a receptacle base having at least one cue, wherein the firing module further comprises a visual indicator display configured to display the assigned visual indicator for the module;

a firing control system communicatively coupled to the firing module, wherein the firing control system comprises a power source, an antenna, a transceiver, a memory wherein the memory includes an indicator database of one or more firing modules, a microcontroller wherein the microcontroller is configured to sense and assign one of more firing modules and one or more individual cues of a firing module a visual indicator, and a display, wherein the firing module visual indicator and cue visual indicator is provided to the user on the display; and an igniter cable system comprising at least one igniter cable having a first end and a second end, wherein an igniting member is communicatively coupled on the first end of the cable and a receptacle plug is coupled on the second end of the cable, wherein the receptacle plug is configured to removably couple from the receptacle base of the firing module, wherein the firing module and the firing control system are wirelessly coupled via a network, wherein the firing module further comprises a length and type detection system configured to detect the type and length of one or more igniter cables; and a continuity detection configured to detect the presence of one or more igniter cables, wherein the receptacle plug is a single plug having a plurality of igniter cables, wherein the single plug is removably couplable to the receptacle base having individual cues associated with each individual igniter cable, wherein the microcontroller can activate the igniter cable of each individual igniter cable separate from each other.

7. An igniter cable system, comprising:

a plurality of igniter cables comprising a first end and a second, wherein the first end of each igniter cable includes an igniting member; and a single cable plug for accepting the second end of each of the plurality of igniter cables, the plurality of igniter cables bundled together by the single cable plug and the second end of each of the plurality of igniter cables crimped onto the single cable plug, wherein the single cable plug includes an individual cue for each individual igniter cable and said single cable plug is configured to be removably coupled to a receptacle base of a firing module.

* * * * *